US011438696B2

(12) United States Patent
Yanagi et al.

(10) Patent No.: US 11,438,696 B2
(45) Date of Patent: Sep. 6, 2022

(54) ACTIVE NOISE REDUCTION DEVICE AND ACTIVE NOISE REDUCTION METHOD

(71) Applicant: Panasonic Intellectual Property Management Co., Ltd., Osaka (JP)

(72) Inventors: Shota Yanagi, Osaka (JP); Kazuhisa Kotegawa, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 17/209,733

(22) Filed: Mar. 23, 2021

(65) Prior Publication Data

US 2021/0306745 A1 Sep. 30, 2021

(30) Foreign Application Priority Data

Mar. 27, 2020 (JP) ..... JP2020-058055

(51) Int. Cl.
*H04R 3/02* (2006.01)

(52) U.S. Cl.
CPC ..... *H04R 3/02* (2013.01); *H04R 2499/13* (2013.01)

(58) Field of Classification Search
CPC .... H04R 3/02; H04R 2499/13; H04R 29/001; H04R 29/00; G10K 11/178; G10K 11/1781; G10K 2210/1282
See application file for complete search history.

(56) References Cited

U.S. PATENT DOCUMENTS 6,681,019 B1 * 1/2004 Kitano ..... H04R 5/04 381/59
7,734,054 B2 * 6/2010 Asada ..... H04R 29/001 381/59
2006/0062399 A1 * 3/2006 McKee Cooper ..... H04S 7/301 381/59
2011/0299691 A1 12/2011 Yoshino
2012/0148060 A1 * 6/2012 Isberg ..... G10K 11/17857 381/71.1

(Continued)

FOREIGN PATENT DOCUMENTS

JP 49-106315 A 10/1974
JP 09-130896 A 5/1997

(Continued)

*Primary Examiner* — Jason R Kurr
(74) *Attorney, Agent, or Firm* — Greenblum & Bernstein, P.L.C.

(57) ABSTRACT

An active noise reduction device includes an impulsive signal generator that generates an impulsive signal, a signal output terminal that outputs the impulsive signal to a loudspeaker, and a signal detector that detects a rising signal and a falling signal from a microphone signal outputted from a microphone collecting sound. The device also includes a connection determiner that determines, based on respective peak values of the rising signal detected and the falling signal detected, whether or not the loudspeaker is connected to the signal output terminal. The device further includes a polarity determiner that determines a connection polarity between the loudspeaker and the signal output terminal based on respective timings of the rising signal and the falling signal with respect to the impulsive signal, when it is determined that the loudspeaker is connected to the signal output terminal.

11 Claims, 7 Drawing Sheets

(56) References Cited

U.S. PATENT DOCUMENTS

2015/0063581 A1 3/2015 Tani et al.

FOREIGN PATENT DOCUMENTS

| | | | |
|---|---|---|---|
| JP | 3480636 | B2 | 12/2003 |
| JP | 2019-161626 | A | 9/2019 |
| WO | 2010/097924 | A1 | 9/2010 |
| WO | 2014/006846 | A1 | 1/2014 |

* cited by examiner

ACTIVE NOISE REDUCTION DEVICE AND ACTIVE NOISE REDUCTION METHOD

CROSS REFERENCE TO RELATED APPLICATION

The present application is based on and claims priority of Japanese Patent Application No. 2020-058055 filed on Mar. 27, 2020.

FIELD

The present disclosure relates to an apparatus, a method, and the like for actively reducing noise by interfering with the noise with canceling sound.

BACKGROUND

Conventionally, an active noise reduction device has been known that actively reduces noise by outputting canceling sound for canceling the noise from a canceling sound source with the use of a reference signal having a correlation with the noise, and an error signal based on the residual sound in a predetermined space (for example, refer to PTL 1). The active noise reduction device generates a canceling signal for outputting the canceling sound by using an adaptive filter, so that the sum of squares of the error signal is minimized.

CITATION LIST

Patent Literature

PTL 1: International Publication No. WO2014/006846

SUMMARY

However, there is a room for improvement in the active noise reduction device in the above-mentioned PTL 1. Therefore, in the present disclosure, an active noise reduction device capable of aiming at further improvement is provided.

In accordance with an aspect of the present disclosure, an active noise reduction device reduces noise, and includes: an impulse signal generator that generates an impulse signal; a signal output unit that outputs the impulse signal to a loudspeaker for reducing the noise; a signal detector that detects a rising signal and a falling signal from a microphone signal outputted from a microphone collecting sound; a connection determiner that determines, based on respective peak values of the rising signal detected and the falling signal detected, whether or not the loudspeaker is connected to the signal output unit; and a polarity determiner that determines a connection polarity between the loudspeaker and the signal output unit based on respective timings of the rising signal and the falling signal with respect to the impulse signal, when the connection determiner determines that the loudspeaker is connected to the signal output unit.

It should be noted that general or specific aspects of the present disclosure may be implemented to a system, an integrated circuit, a computer program, a computer-readable recording medium such as a Compact Disc-Read Only Memory (CD-ROM), or any given combination thereof. The recording medium may be a non-transitory computer-readable recording medium.

The active noise reduction device according to one aspect of the present disclosure is capable of aiming at further improvement.

BRIEF DESCRIPTION OF DRAWINGS

Further advantages and effects in one aspect of the present disclosure will be made apparent from the specification and the drawings. Although each of such advantages and/or effects is provided by features described in some embodiments as well as the specification and the drawings, not everything necessarily needs to be provided in order to obtain one or more identical features.

Figure 1:
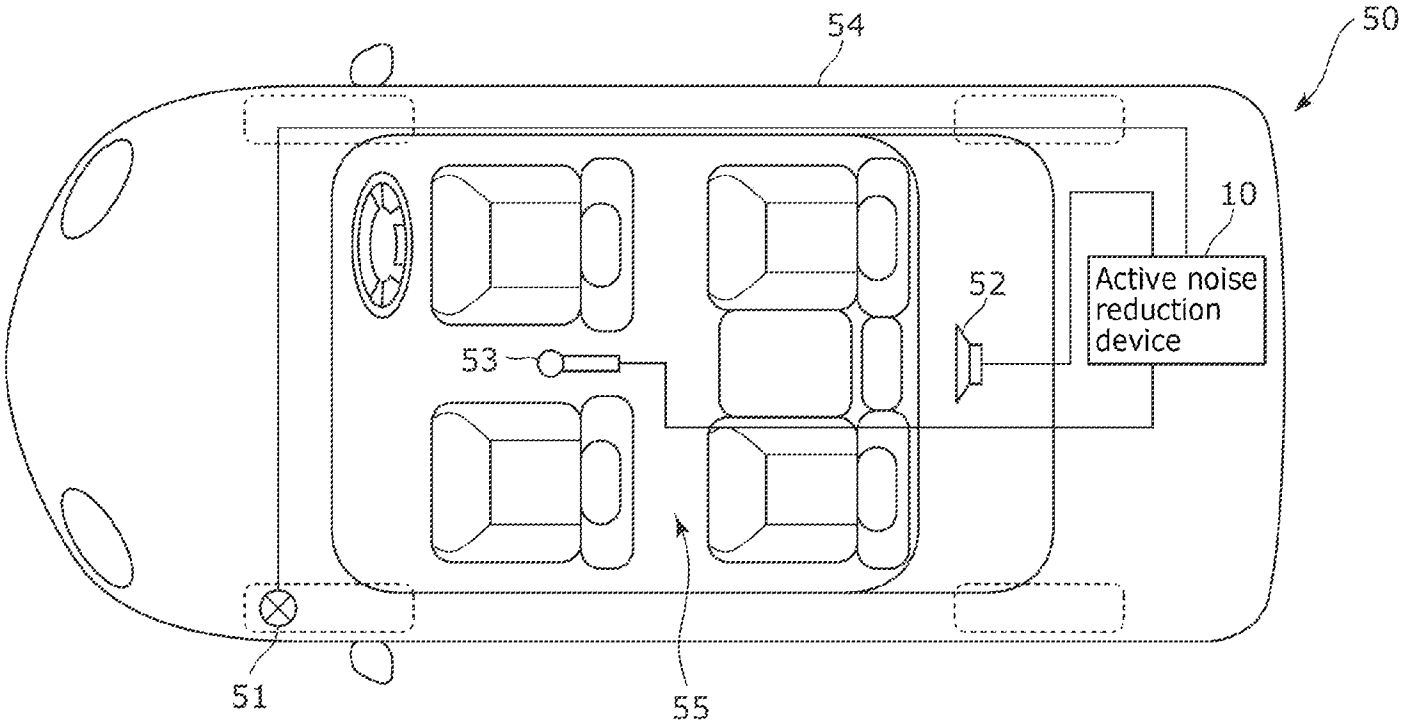
FIG. 1 is a schematic diagram of a vehicle including an active noise reduction device in an embodiment, viewed from above.

DESCRIPTION OF EMBODIMENT (Findings Underlying the Present Disclosure)

The present inventor found out that the following problems occurred on the active noise reduction device in the above-mentioned PTL 1 described in the section of "Background."

In the active noise reduction device in the above-mentioned PTL 1, a loudspeaker, which is a canceling sound source for outputting the canceling sound, may not be connected to the active noise reduction device with an appropriate polarity. Therefore, the noise to be reduced may be rather amplified by the sound outputted from the loudspeaker.

Therefore, the present disclosure provides an active noise reduction device capable of appropriately suppressing the occurrence of a phenomenon that noise cannot be reduced.

In accordance with an aspect of the present disclosure, an active noise reduction device that reduces noise and includes: an impulse signal generator that generates an impulse signal; a signal output unit that outputs the impulse signal to a loudspeaker for reducing the noise; a signal detector that detects a rising signal and a falling signal from a microphone signal outputted from a microphone collecting sound; a connection determiner that determines, based on respective peak values of the rising signal detected and the falling signal detected, whether or not the loudspeaker is connected to the signal output unit; and a polarity determiner that determines a connection polarity between the loudspeaker and the signal output unit based on respective timings of the rising signal and the falling signal with respect to the impulse signal, when the connection determiner determines that the loudspeaker is connected to the signal output unit.

Accordingly, whether or not the loudspeaker is connected to the signal output unit of the active noise reduction device is determined. Therefore, it is possible to suppress the occurrence of a phenomenon that noise cannot be reduced since the loudspeaker is not connected to the active noise reduction device. Further, when the loudspeaker is connected to the active noise reduction device, the connection polarity of the loudspeaker is determined. Therefore, it is possible to suppress the occurrence of a phenomenon that noise is rather amplified since the connection polarity of the loudspeaker is the negative connection polarity. Additionally, the determination of the connection polarity of the loudspeaker is not performed based on the timing of only either one of the rising signal and the falling signal detected from the microphone signal, but based on the timings of both of them. Accordingly, it is possible to suppress the possibility that the connection polarity is erroneously determined.

It is possible that the polarity determiner determines the connection polarity by determining which of the rising signal and the falling signal occurs at each of a first timing and a second timing, the first timing corresponding to starting the outputting of the impulse signal, the second timing corresponding to stopping the outputting of the impulse signal. For example, it is possible that when the rising signal occurs at the first timing and the falling signal occurs at the second timing, the polarity determiner determines that the connection polarity is positive.

Accordingly, it is possible to appropriately determine whether or not the connection polarity is right.

It is also possible that the signal detector detects the rising signal and the falling signal from the microphone signal, during a determination period between a determination start timing and a determination completion timing, the determination period being set in accordance with a distance between the loudspeaker and the microphone and a timing of outputting the impulse signal.

Accordingly, the rising signal and the falling signal are detected in the determination period from the determination start timing to the determination completion timing. Therefore, outside the determination period, the detection of the rising signal and the falling signal can be stopped. As a result, in the determination period, the determination of the connection and connection polarity of the loudspeaker can be performed, and outside the determination period, the determination of the connection and connection polarity of the loudspeaker can be omitted. Additionally, the above-described determination period is set according to the distance between the loudspeaker and the microphone, and the timing of outputting the impulse signal. Therefore, it is highly likely that the sound outputted from the loudspeaker according to the impulse signal is collected with the microphone in the determination period. Therefore, as described above, it is possible to further suppress the possibility of erroneously determining the connection and connection polarity of the loudspeaker, by omitting the determination outside the determination period.

It is further possible that the connection determiner determines that the loudspeaker is connected to the signal output unit, when each of absolute values of the respective peak values of the rising signal and the falling signal is equal to or greater than a threshold value.

Accordingly, when each of the absolute values of the respective peak values of the rising signal and the falling signal is less than the threshold value, it is determined that the loudspeaker is not connected, and the determination of the connection polarity of the loudspeaker can be omitted. That is, it is possible to suppress that the connection polarity of the loudspeaker is erroneously determined based on the background noise, instead of the sound outputted from the loudspeaker according to the impulse signal.

It is still further possible that the active noise reduction device further includes: a canceling signal generator that generates a canceling signal and outputs the canceling signal to the signal output unit, wherein when the polarity determiner determines that the connection polarity is negative, the canceling signal generator inverses a phase of the canceling signal generated to cause the loudspeaker to output canceling sound to reduce the noise.

Accordingly, when the connection polarity of the loudspeaker is the negative connection polarity, the phase of the canceling signal is inversed. That is, the reversed-phase canceling signal is generated, and the noise is reduced by the canceling sound outputted from the loudspeaker according to the reversed-phase canceling signal. Therefore, it is possible for an operator to save the effort of manually fixing the wiring between the loudspeaker and the signal output unit of the active noise reduction device, and setting the connection polarity of the loudspeaker to the positive connection polarity.

It is still further possible that when a plurality of microphones are connected to the active noise reduction device, the polarity determiner determines the connection polarity between the loudspeaker and the signal output unit, based on respective timings of a rising signal and a falling signal which are detected from a microphone signal of a microphone closest to the loudspeaker among the plurality of microphones.

Accordingly, since the microphone closest to the loudspeaker is used for the determination of the connection polarity of the loudspeaker, the accuracy of determining the connection polarity can be improved.

It is still further possible that the signal detector detects a rising signal and a falling signal from a microphone signal outputted from each of the plurality of microphones. Here, it is possible that the active noise reduction device further includes: a connection order determiner that determines whether or not the plurality of microphones are connected to the active noise reduction device in a predetermined order, based on (i) respective timings of a rising signal and a falling signal of a microphone signal outputted from each of the plurality of microphones and (ii) a timing of outputting the impulse signal.

Accordingly, it is possible to appropriately determine whether or not the plurality of microphones are connected to the active noise reduction device in an erroneous order. As a result, for example, when the plurality of microphones are connected in an erroneous order, it is possible to suppress that the connection polarity of the loudspeaker is determined by using a microphone different from the microphone closest to the loudspeaker.

It is still further possible that the active noise reduction device is mounted on a vehicle.

Accordingly, it is possible to suppress the occurrence of a phenomenon that noise cannot be reduced in the internal space of a vehicle.

In accordance with another aspect of the present disclosure, an active noise reduction device reduces noise in a space in a movable device, and includes: a reference signal receiver that receives a reference signal from a reference signal source installed in the movable device, the reference signal being correlated with the noise; a canceling signal generator that generates a canceling signal by applying an adaptive filter to the reference signal received by the reference signal receiver; a signal output unit that outputs the canceling signal generated to a loudspeaker; and a loudspeaker polarity determiner that determines whether a connection polarity between the loudspeaker and the signal output unit is positive or negative, wherein when the loudspeaker polarity determiner determines that the connection polarity is negative, the canceling signal generator inverses a phase of the canceling signal generated to cause the loudspeaker to output canceling sound to reduce the noise.

Accordingly, when the connection polarity of the loudspeaker is the negative connection polarity, the phase of the canceling signal is inversed. That is, the reversed-phase canceling signal is generated, and the noise is reduced by the canceling sound outputted from the loudspeaker according to the reversed-phase canceling signal. Therefore, it is possible to appropriately suppress the occurrence of a phenomenon that noise cannot be reduced. Further, it is possible for the operator to save the effort of manually fixing the wiring between the loudspeaker and the signal output unit of the active noise reduction device, and setting the connection polarity of the loudspeaker to the positive connection polarity.

Hereinafter, certain exemplary embodiments will be described in detail with reference to the accompanying Drawings.

The following embodiments are general or specific examples of the present disclosure. The numerical values, shapes, materials, elements, arrangement and connection configuration of the elements, steps, the order of the steps, etc., described in the following embodiments are merely examples, and are not intended to limit the present disclosure. Among elements in the following embodiments, those not described in any one of the independent claims indicating the broadest concept of the present disclosure are described as optional elements.

The respective figures are schematic diagrams and are not necessarily precise illustrations. Additionally, components that are essentially the same share like reference signs in the figures.

EMBODIMENTS

[Configuration of Vehicle Including Active Noise Reduction Device]

FIG. 1 is a schematic diagram of a vehicle including an active noise reduction device in an embodiment, viewed from above.

Vehicle 50 is an example of a movable device, and includes active noise reduction device 10, reference signal source 51, loudspeaker 52, microphone 53, and vehicle body 54. Vehicle 50 is specifically an automobile, but is not particularly limited.

Reference signal source 51 is a transducer that outputs a reference signal having a correlation with noise in space 55 inside the cabin of vehicle 50. In the present embodiment, reference signal source 51 is an acceleration sensor, and is arranged outside space 55. Specifically, reference signal source 51 is installed to a sub frame in the vicinity of a forward left wheel (or a tire house of the forward left wheel). Note that the installation position of reference signal source 51 is not particularly limited. Additionally, reference signal source 51 may be a microphone.

Loudspeaker 52 outputs a canceling sound to space 55 by using a canceling signal. Note that loudspeaker 52 may include a part of the structure of vehicle 50 (for example, a sunroof or the like), and a drive mechanism such as an actuator, and may output the canceling sound with vibration to the structure by the drive mechanism. Additionally, although the number of loudspeakers 52 is one in the present embodiment, the number is not limited to one, and may be plural. In addition, the installation position of loudspeaker 52 is not particularly limited.

Microphone 53 collects sound in space 55, and outputs a microphone signal according to the result of the collected sound. For example, microphone 53 detects residual sound obtained by the interference between the noise and the canceling sound in space 55, and outputs an error signal based on the residual sound as the microphone signal. Note that microphone 53 is installed in, for example, a headliner or the like. Additionally, in the present embodiment, although the number of microphones 53 is one, the number may be plural, without being limited to one.

Vehicle body 54 is a structure formed by a chassis, a body, and the like of vehicle 50. Body 54 of a vehicle forms space 55 (the space inside the cabin) where loudspeaker 52 and microphone 53 are arranged.

Active noise reduction device 10 is mounted in vehicle 50. Active noise reduction device 10 as such generates the above-described canceling signal based on the reference signal outputted from reference signal source 51, and the microphone signal outputted from microphone 53, and outputs the canceling signal to loudspeaker 52. Accordingly, the canceling sound is outputted to space 55 from loudspeaker 52. As a result, the noise in space 55 can be reduced. Additionally, in active noise reduction device 10 in the present embodiment, since the connection polarity of loudspeaker 52 is determined as described later, it is possible to suppress the occurrence of a phenomenon that noise cannot be reduced in space 55 of vehicle 50.

[Configuration of Active Noise Reduction Device]

Figure 2:
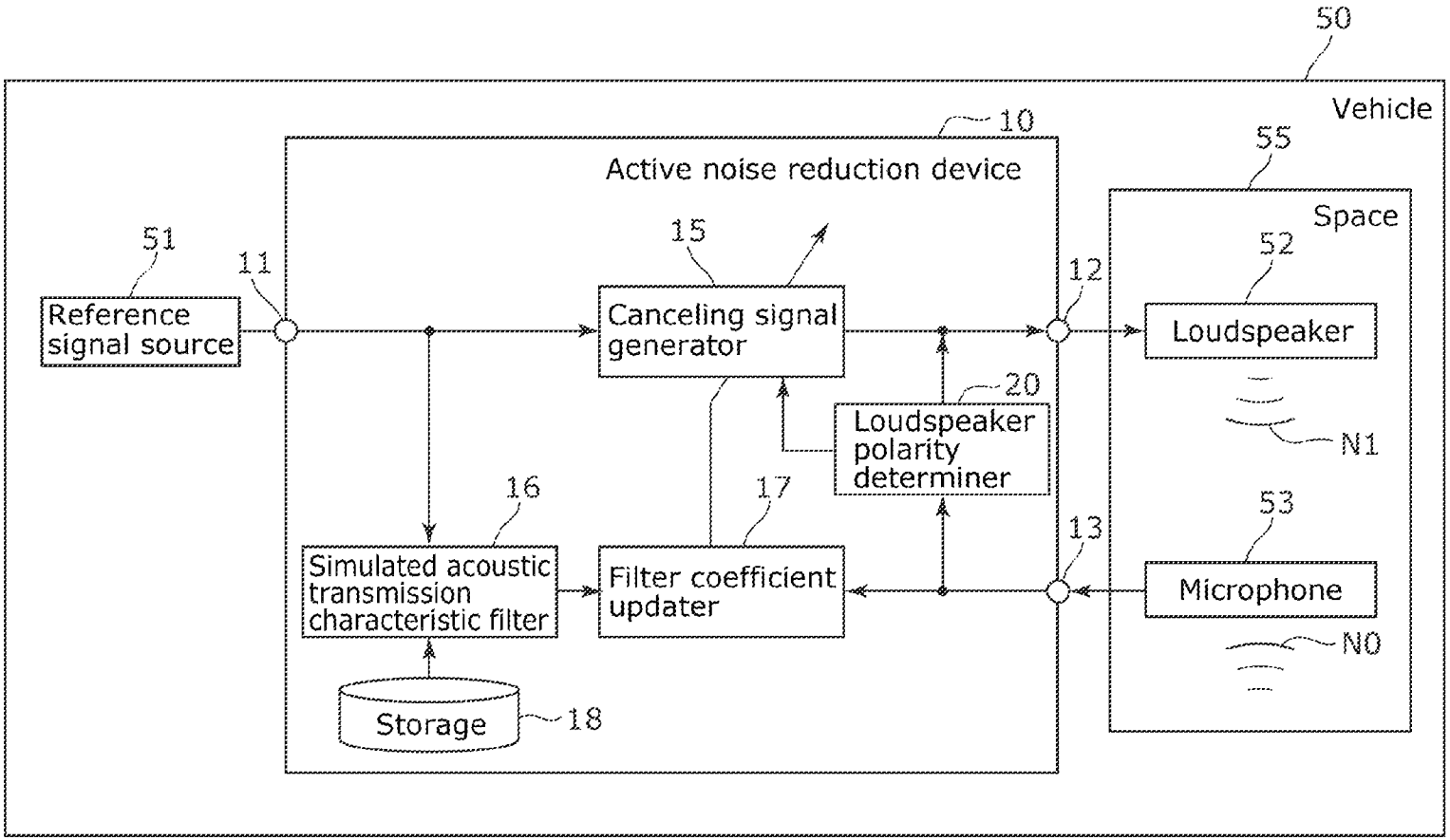
FIG. 2 is a block diagram showing the functional configuration of the active noise reduction device in the embodiment.

FIG. 2 is a block diagram showing the functional configuration of active noise reduction device 10.

Active noise reduction device 10 includes, as shown in FIG. 2, reference signal input terminal 11, signal output terminal 12, microphone signal input terminal 13, canceling signal generator 15, simulated acoustic transmission characteristic filter 16, filter coefficient updater 17, storage 18, and loudspeaker polarity determiner 20.

Each component of canceling signal generator 15, simulated acoustic transmission characteristic filter 16, filter coefficient updater 17, and loudspeaker polarity determiner 20 may be realized by, for example, hardware and software. That is, these components may be realized by, for example, executing software by a processor, such as a DSP (Digital Signal Processor), or a microcomputer. Alternatively, these components may be realized by hardware, such as dedicated circuits.

The reference signal having a correlation with noise NO is inputted to reference signal input terminal 11 from reference signal source 51. Reference signal input terminal 11 is an example of a reference signal receiver, and specifically is a terminal made of a metal or the like. The reference signal inputted to reference signal input terminal 11 is outputted to canceling signal generator 15 and simulated acoustic transmission characteristic filter 16.

Canceling signal generator 15 generates the canceling signal by applying (that is, multiplying) an adaptive filter to the reference signal inputted to reference signal input terminal 11. Canceling signal generator 15 is realized by a so-called FIR (Finite Impulse Response) filter or IIR (Infinite Impulse Response) filter. Canceling signal generator 15 outputs the generated canceling signal to signal output terminal 12. The canceling signal is used for outputting canceling sound N1 for reducing noise NO from loudspeaker 52.

Signal output terminal 12 is an example of a signal output unit, and is a terminal made of a metal or the like. Signal output terminal 12 is a terminal for outputting the canceling signal generated by canceling signal generator 15 to loudspeaker 52. Loudspeaker 52 is connected to signal output terminal 12. Therefore, the canceling signal is outputted to loudspeaker 52 via signal output terminal 12. Loudspeaker 52 outputs canceling sound N1 based on the canceling signal.

Microphone 53 detects the residual sound by collecting sound, and outputs the error signal corresponding to the residual sound as the microphone signal. The residual sound is sound generated by the interference between canceling sound N1 generated from loudspeaker 52 according to the canceling signal, and noise NO.

The error signal is inputted to microphone signal input terminal 13 as the microphone signal. Microphone signal input terminal 13 is a terminal made of a metal or the like.

Simulated acoustic transmission characteristic filter 16 generates a filtered reference signal obtained by correcting the reference signal with the simulated transmission characteristic that imitates the acoustic transmission characteristic from signal output terminal 12 to microphone signal input terminal 13. The simulated transmission characteristic simulates the acoustic transmission characteristic from the position of loudspeaker 52 to the position of microphone 53. The simulated transmission characteristic is, for example, measured in advance in space 55, and is stored in storage 18. Note that the simulated transmission characteristic may be defined by an algorithm that does not use a predefined value.

Storage 18 is a storage apparatus in which the simulated transmission characteristic is stored. Storage 18 is specifically realized by a semiconductor memory or the like. Note that, when canceling signal generator 15, simulated acoustic transmission characteristic filter 16, and filter coefficient updater 17 are realized by a processor such as a DSP, a control program executed by the processor may also be stored in storage 18. Parameters used for signal processing performed by canceling signal generator 15, simulated acoustic transmission characteristic filter 16, and filter coefficient updater 17 may be stored in storage 18.

Filter coefficient updater 17 successively updates coefficient W of the adaptive filter based on the error signal and the generated filtered reference signal. Specifically, filter coefficient updater 17 uses the LMS (Least Mean Square) method to calculate coefficient W of the adaptive filter so that the sum of squares of the error signal is minimized, and outputs the calculated coefficient of the adaptive filter to canceling signal generator 15.

Loudspeaker polarity determiner 20 determines the connection polarity of loudspeaker 52. That is, loudspeaker polarity determiner 20 determines whether the connection polarity between loudspeaker 52 and signal output terminal 12 is the positive connection polarity or the negative connection polarity. The connection polarity is the polarity of signal output terminal 12 to which loudspeaker 52 is connected. The positive connection polarity is the state where loudspeaker 52 is correctly connected to the positive terminal and negative terminal of signal output terminal 12. On the other hand, the negative connection polarity is the state where loudspeaker 52 is connected to the positive terminal and negative terminal of signal output terminal 12 in a manner opposite to the positive connection polarity.

Specifically, loudspeaker polarity determiner 20 outputs a signal to loudspeaker 52 via signal output terminal 12, thereby making loudspeaker 52 output sound. At this time, loudspeaker polarity determiner 20 receives, via microphone signal input terminal 13, the microphone signal outputted from microphone 53 by collecting sound with microphone 53. Then, loudspeaker polarity determiner 20 determines the connection polarity of loudspeaker 52 by using the microphone signal.

In a case where the connection polarity is the negative connection polarity, even when the canceling signal generated by canceling signal generator 15 is outputted to loudspeaker 52, the above-described noise cannot be reduced due to the sound outputted from loudspeaker 52, and the noise will be rather increased. Therefore, when loudspeaker polarity determiner 20 in the present embodiment determines that the connection polarity is the negative connection polarity, loudspeaker polarity determiner 20 instructs canceling signal generator 15 to inverse the phase of the canceling signal.

When canceling signal generator 15 receives the instruction from loudspeaker polarity determiner 20, canceling signal generator 15 inverses the phase of the canceling signal to be generated, and output the phase-inversed canceling signal to signal output terminal 12. That is, when it is determined by loudspeaker polarity determiner 20 that the connection polarity is the negative connection polarity, canceling signal generator 15 in the present embodiment causes loudspeaker 52 to output the canceling sound for reducing the noise by inversing the phase of the canceling signal to be generated.

Therefore, in the present embodiment, when the connection polarity of loudspeaker 52 is the negative connection polarity, the phase of the canceling signal is inversed. That is, the reversed-phase canceling signal is generated, and the noise is reduced by the canceling sound outputted from loudspeaker 52 according to the reversed-phase canceling signal. Therefore, it is possible for the operator to save the effort of manually fixing the wiring between loudspeaker 52 and signal output terminal 12 of active noise reduction device 10, and setting the connection polarity of loudspeaker 52 to the positive connection polarity.

[Configuration of Loudspeaker Polarity Determiner]

Figure 3:
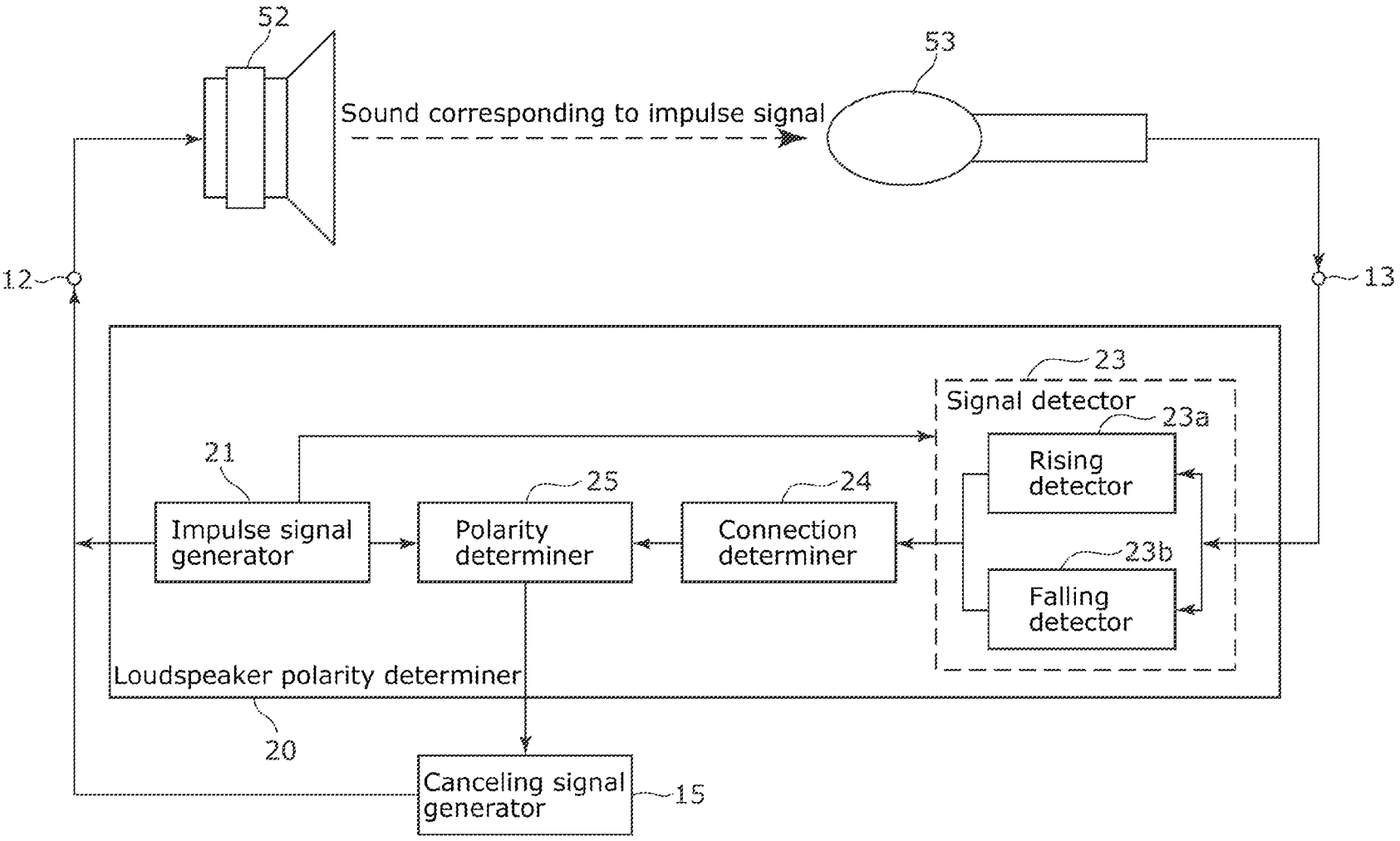
FIG. 3 is a block diagram showing the functional configuration of a loudspeaker polarity determiner in the embodiment.

FIG. 3 is a block diagram showing the functional configuration of loudspeaker polarity determiner 20.

Loudspeaker polarity determiner 20 includes impulse signal generator 21, signal detector 23, connection determiner 24, and polarity determiner 25.

Impulse signal generator 21 generates an impulse signal. The impulse signal is, for example, a square wave indicating a voltage value of High during 100 msec. Impulse signal generator 21 performs signal output processing for outputting the impulse signal as such to loudspeaker 52 used for reducing the above-described noise via signal output terminal 12. Here, signal output terminal 12 is used for outputting the impulse signal to loudspeaker 52 used for reducing the noise.

Further, when impulse signal generator 21 outputs the impulse signal to signal output terminal 12, impulse signal generator 21 also simultaneously outputs the impulse signal to each of signal detector 23 and polarity determiner 25.

When loudspeaker 52 receives the impulse signal from impulse signal generator 21 via signal output terminal 12, loudspeaker 52 outputs the sound corresponding to the impulse signal.

Microphone 53 collects sound, and outputs the microphone signal according to the result of the collected sound to loudspeaker polarity determiner 20 via microphone signal input terminal 13. That is, when the sound corresponding to impulse signal is collected by microphone 53, the microphone signal according to the sound is outputted to loudspeaker polarity determiner 20.

Signal detector 23 receives the microphone signal from microphone 53 via microphone signal input terminal 13, and detects a rising signal and a falling signal from the microphone signal. That is, signal detector 23 detects the rising signal and the falling signal from the microphone signal outputted from microphone 53 by collecting the sound with microphone 53. Specifically, signal detector 23 includes rising detector 23*a* and falling detector 23*b*. Rising detector 23*a* detects the rising signal from the microphone signal, and falling detector 23*b* detects the falling signal from the microphone signal.

Connection determiner 24 determines whether or not loudspeaker 52 is connected to signal output terminal 12, based on the respective peak values of the detected rising signal and falling signal.

When it is determined by connection determiner 24 that loudspeaker 52 is connected, polarity determiner 25 determines the connection polarity between loudspeaker 52 and signal output terminal 12 based on the respective timings of the rising signal and the falling signal on the basis of the impulse signal.

Example of Each Signal

Figure 4:
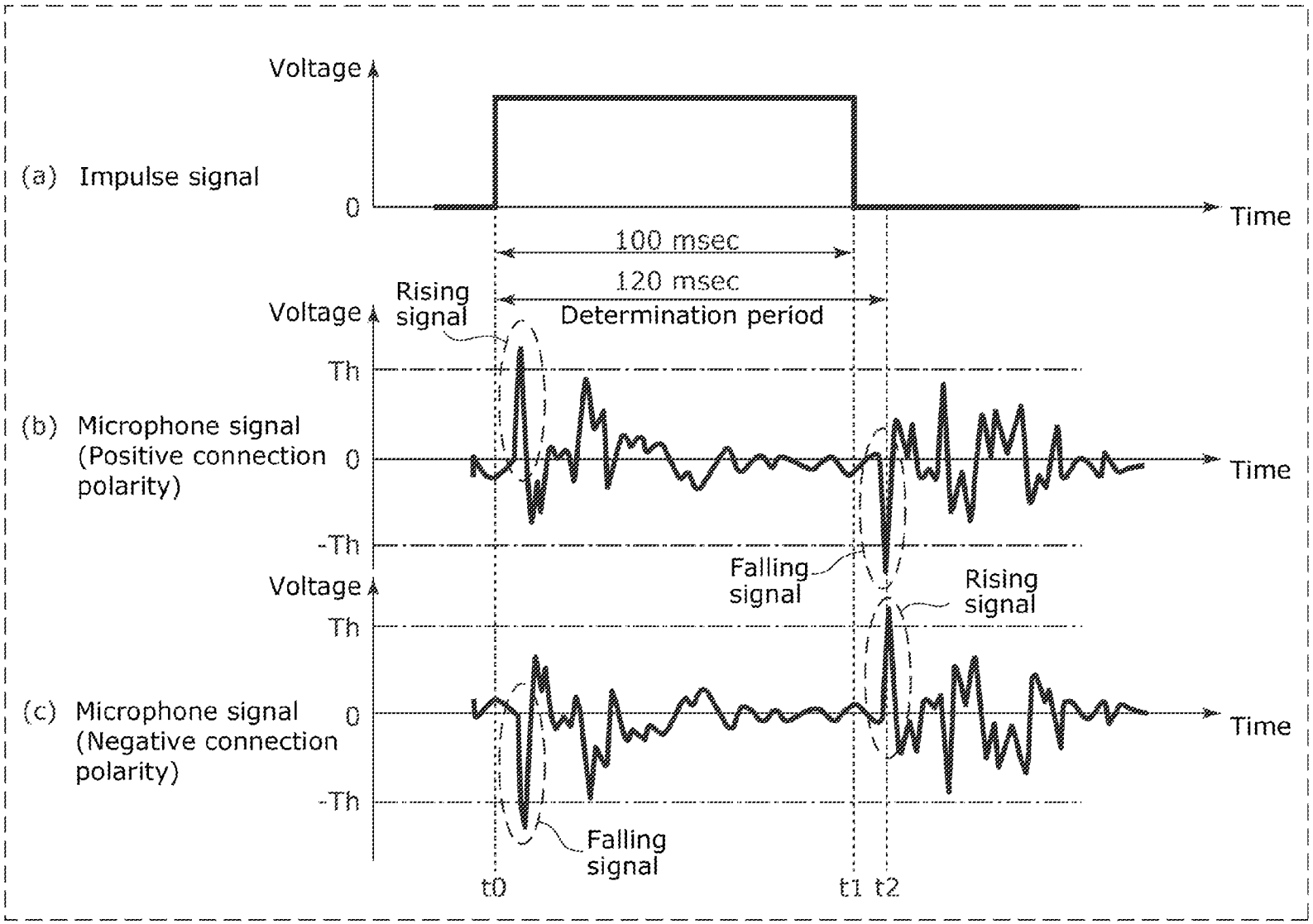
FIG. 4 is a diagram showing examples of an impulse signal and microphone signals in the embodiment.

FIG. 4 is a diagram showing examples of the impulse signal and the microphone signals. Specifically, (a) in FIG. 4 shows an example of the impulse signal, (b) in FIG. 4 shows an example of the microphone signal in a case where the connection polarity of loudspeaker 52 is the positive connection polarity, and (c) in FIG. 4 shows an example of the microphone signal in a case where the connection polarity of loudspeaker 52 is the negative connection polarity.

As shown in (a) in FIG. 4, impulse signal generator 21 generates the impulse signal during, for example, time t0 to time t1, and outputs the impulse signal to signal output terminal 12.

When loudspeaker 52 is connected to signal output terminal 12, and the connection polarity of loudspeaker 52 is the positive connection polarity, microphone 53 outputs the microphone signal shown in (b) in FIG. 4 according to the impulse signal shown in (a) in FIG. 4.

When signal detector 23 receives the microphone signal via microphone signal input terminal 13, signal detector 23 sets a determination period, and detects the rising signal and the falling signal from the microphone signal in the determination period. Specifically, in the determination period between a determination start timing and a determination completion timing that are set according to the distance between loudspeaker 52 and microphone 53, and the timing of outputting the impulse signal, signal detector 23 detects the rising signal and the falling signal from the microphone signal.

For example, signal detector 23 sets the above-described determination period by determining the time t0 at which the outputting of the impulse signal shown in (a) in FIG. 4 is started as the determination start timing, and determining the time t2 that is after the time t1 and at which the outputting of the impulse signal is stopped as the determination completion timing. For example, the time between time t1 and time t2 may be the time obtained by dividing the distance between loudspeaker 52 and microphone 53 by the speed of sound, or may be the time obtained by adding a predetermined time to the time obtained by the division. For example, when the output time of the impulse signal is 100 msec, the determination period may be 120 msec. Note that the determination period may be constituted by a first determination period corresponding to the timing at which outputting of the impulse signal is started, and a second determination period corresponding to the timing at which outputting of the impulse signal is stopped. The first determination period may be the period from time t0 to (time t0+(time t2−time t1)+α), and the second determination period may be the period from time t1 to (time t2+α). α may be 0, or may be a predefined time.

Rising detector 23*a* of signal detector 23 detects the rising signal in the determination period, and falling detector 23*b* detects the falling signal in the determination period.

When each of the absolute values of the respective peak values of the rising signal and the falling signal that are detected by signal detector 23 is equal to or greater than a threshold value, connection determiner 24 determines that loudspeaker 52 is connected. For example, in the microphone signal shown by each of (b) and (c) in FIG. 4, the peak value of the rising signal detected in the above-described determination period is equal to or greater than Th. Additionally, the peak value of the falling signal detected in the determination period is equal to or less than −Th. Therefore, in the examples shown in (b) and (c) in FIG. 4, since each of the absolute values of the respective peak values of the detected rising signal and falling signal is equal to or greater than threshold value Th, connection determiner 24 determines that loudspeaker 52 is connected to signal output terminal 12.

Polarity determiner 25 determines the connection polarity of loudspeaker 52 by determining which of the rising signal and the falling signals occurs at each of the first timing corresponding to starting the outputting of the impulse signal, and the second timing corresponding to stopping the outputting of the impulse signal. In the example shown in FIG. 4, the first timing is the timing corresponding to time t0 at which the outputting of the impulse signal is started. For example, the first timing may be the timing delayed from time t0 by the time obtained by dividing the distance between loudspeaker 52 and microphone 53 by the speed of sound. In the example shown in FIG. 4, the second timing is the timing corresponding to time t1 at which the outputting of the impulse signal is stopped. For example, the second timing may be the timing delayed from time t1 by the time obtained by dividing the distance between loudspeaker 52 and microphone 53 by the speed of sound. In other words, polarity determiner 25 determines the connection polarity of loudspeaker 52 by determining which of the rising signal and the falling signal occurs at each of the timings of the rising edge and falling edge of the impulse signal.

For example, as shown in (b) in FIG. 4, when the rising signal occurs at the first timing, and the falling signal occurs at the second timing, polarity determiner 25 determines that the connection polarity is the positive connection polarity. Additionally, as shown in (c) in FIG. 4, when the falling signal occurs at the first timing, and the rising signal occurs at the second timing, polarity determiner 25 determines that the connection polarity is the negative connection polarity. Accordingly, it is possible to appropriately determine whether or not the connection polarity is right.

As in this example shown in FIG. 4, in the present embodiment, since the rising signal and the falling signal are detected in the determination period from the determination start timing to the determination completion timing, it is possible to stop the detection of the rising signal and the falling signal outside the determination period. As a result, it is possible to perform the determination of the connection and the connection polarity of loudspeaker 52 in the determination period, and to omit the determination of the connection and the connection polarity of loudspeaker 52 outside the determination period. Additionally, since the above-described determination period is set according to the distance between loudspeaker 52 and microphone 53, and the timing of outputting the impulse signal, it is highly likely that the sound outputted from loudspeaker 52 according to the impulse signal is collected with the microphone in the determination period. Therefore, by omitting the determination outside the determination period, it is possible to further suppress the possibility of erroneously determining the connection and the connection polarity of loudspeaker 52. Additionally, as described above, in the present embodiment, when each of the absolute values of the respective peak values of the rising signal and the falling signal is equal to or greater than the threshold value, it is determined that loudspeaker 52 is connected. On the other hand, when the absolute value of the peak value is less than the threshold value, it is determined that loudspeaker 52 is not connected, and determination of the connection polarity of loudspeaker 52 can be omitted. That is, it is possible to suppress that the connection polarity of loudspeaker 52 is erroneously determined based on the background noise, instead of the sound outputted from loudspeaker 52 according to the impulse signal.

[Processing Operation]

Figure 5:
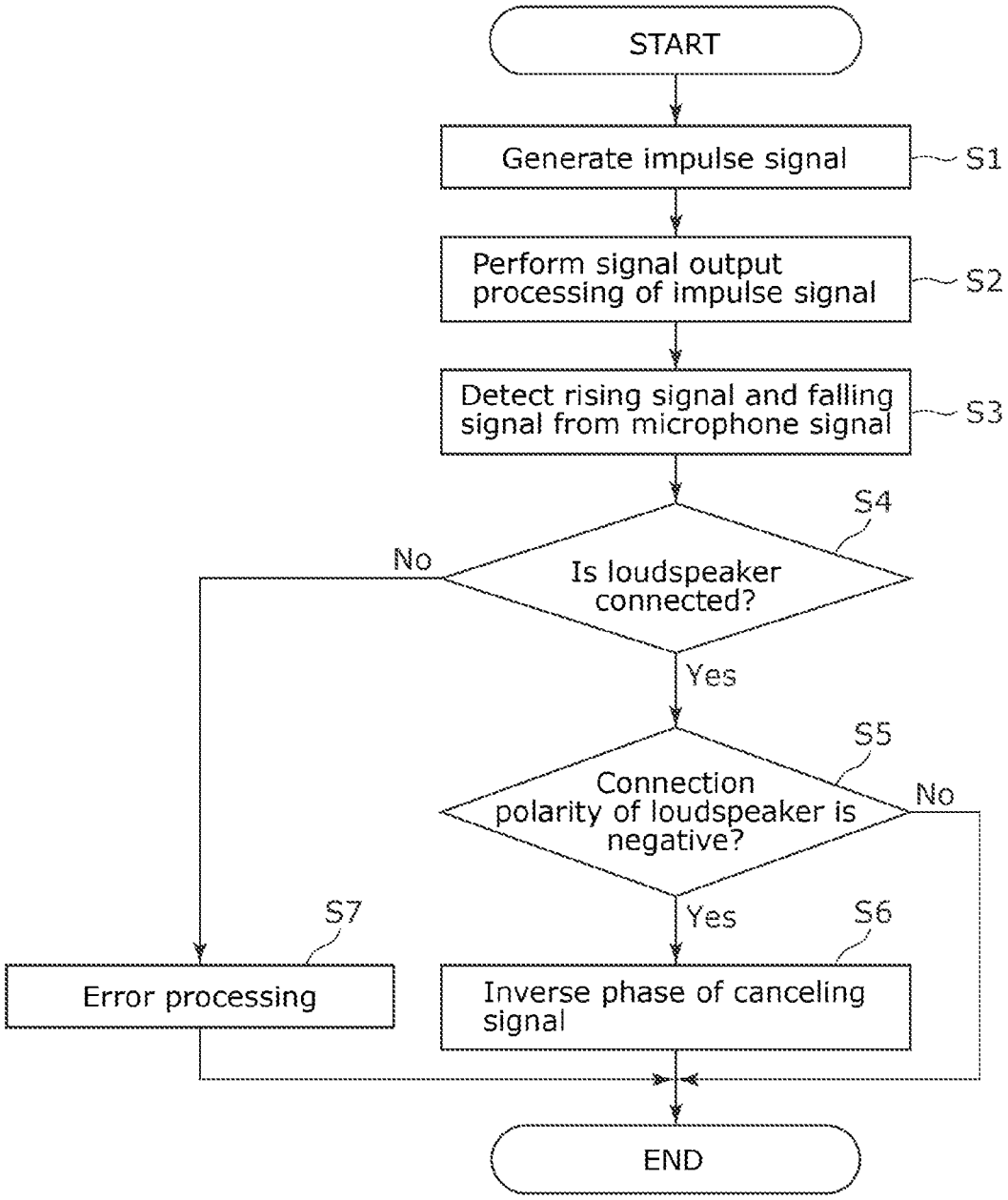
FIG. 5 is a flowchart showing the processing operation of the loudspeaker polarity determiner in the embodiment.

FIG. 5 is a flowchart showing the processing operation of loudspeaker polarity determiner 20 in the present embodiment.

First, impulse signal generator 21 of loudspeaker polarity determiner 20 generates the impulse signal (step S1).

Next, impulse signal generator 21 performs signal output processing for outputting the generated impulse signal to loudspeaker 52 used for reducing the noise via signal output terminal 12 (step S2).

Next, signal detector 23 detects the rising signal and the falling signal from the microphone signal outputted from microphone 53 by collecting sound with microphone 53 (step S3).

Next, connection determiner 24 determines whether or not loudspeaker 52 is connected to signal output terminal 12, based on each of the peak values of the rising signal and the falling signal detected in step S3 (step S4).

Here, when it is determined that loudspeaker 52 is not connected (No in step S4), connection determiner 24 performs error processing (step S7). The error processing may be, for example, processing for reporting that loudspeaker 52 is not connected by outputting sound or displaying an image to the operator who performs installation work of active noise reduction device 10. Additionally, although connection determiner 24 performs the error processing in the example shown in FIG. 5, such error processing need not be performed.

On the other hand, when it is determined that loudspeaker 52 is connected (Yes in step S4), polarity determiner 25 determines the connection polarity between loudspeaker 52 and signal output terminal 12 based on the respective timings of the rising signal and the falling signal on the basis of the above-described impulse signal (step S5). For example, in this step S5, polarity determiner 25 determines whether or not the connection polarity is the negative connection polarity.

Then, when polarity determiner 25 determines that the connection polarity is the negative connection polarity (Yes in step S5), polarity determiner 25 causes canceling signal generator 15 to inverse the phase of the canceling signal generated in that canceling signal generator 15 (step S6).

Figure 6:
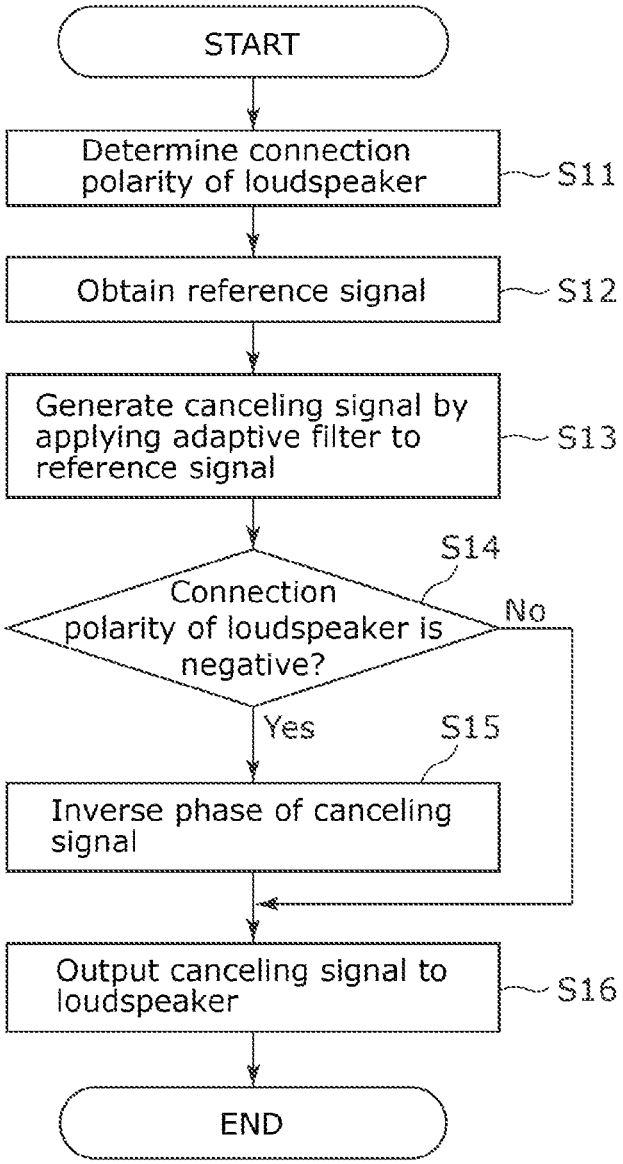
FIG. 6 is a flowchart showing the processing operation of the active noise reduction device in the embodiment.

FIG. 6 is a flowchart showing the processing operation of active noise reduction device 10 in the present embodiment.

First, loudspeaker polarity determiner 20 determines whether the connection polarity between loudspeaker 52 used for reducing the noise and signal output terminal 12 is the positive connection polarity or the negative connection polarity (step S11). At this time, when loudspeaker polarity determiner 20 determines that the connection polarity is the negative connection polarity, loudspeaker polarity determiner 20 instructs canceling signal generator 15 to inverse the phase of the canceling signal.

Next, canceling signal generator 15 obtains the reference signal having a correlation with the noise from reference signal source 51 installed in vehicle 50 (step S12).

Then, canceling signal generator 15 generates the canceling signal by applying the adaptive filter to the obtained reference signal (step S13).

Further, canceling signal generator 15 determines whether or not the instruction to inverse the phase is received from loudspeaker polarity determiner 20, i.e., whether or not the connection polarity of loudspeaker 52 is the negative connection polarity (step S14). Here, when canceling signal generator 15 determines that the instruction to inverse the phase is received, i.e., when canceling signal generator 15 determines that the connection polarity is the negative connection polarity (Yes in step S14), canceling signal generator 15 inverses the phase of the canceling signal generated in step S13 (step S15). That is, in the determination of the connection polarity in step S11, when it is determined that the connection polarity is the negative connection polarity, canceling signal generator 15 inverses the phase of the generated canceling signal.

Then, canceling signal generator 15 outputs the canceling signal generated in step S13, or the canceling signal whose phase is determined in step S14 to loudspeaker 52 via signal output terminal 12 (step S16). Accordingly, canceling signal generator 15 causes loudspeaker 52 to output the canceling sound for reducing the noise.

Effects and the Like

As described above, in active noise reduction device 10 in the present embodiment, whether or not loudspeaker 52 is connected to signal output terminal 12 of active noise reduction device 10 is determined. Therefore, it is possible to suppress the occurrence of a phenomenon that cannot reduce noise since loudspeaker 52 is not connected to active noise reduction device 10. Further, when loudspeaker 52 is connected to active noise reduction device 10, the connection polarity of loudspeaker 52 is determined. Therefore, it is possible to suppress the occurrence of a phenomenon that noise is rather amplified since the connection polarity of loudspeaker 52 is the negative connection polarity. Additionally, the determination of the connection polarity of loudspeaker 52 is not performed based on the timing of only either one of the rising signal and the falling signal detected from the microphone signal, but based on the timings of both of them. Accordingly, it is possible to suppress the possibility that the connection polarity is erroneously determined.

(Modification)

Although vehicle 50 includes one microphone 53 in the above-described embodiment, the number of microphones 53 mounted in vehicle 50 is not limited to one, and may be plural. When a plurality of microphones are mounted in vehicle 50, active noise reduction device 10 and loudspeaker polarity determiner 20 may be connected to each of the plurality of microphones.

Figure 7:
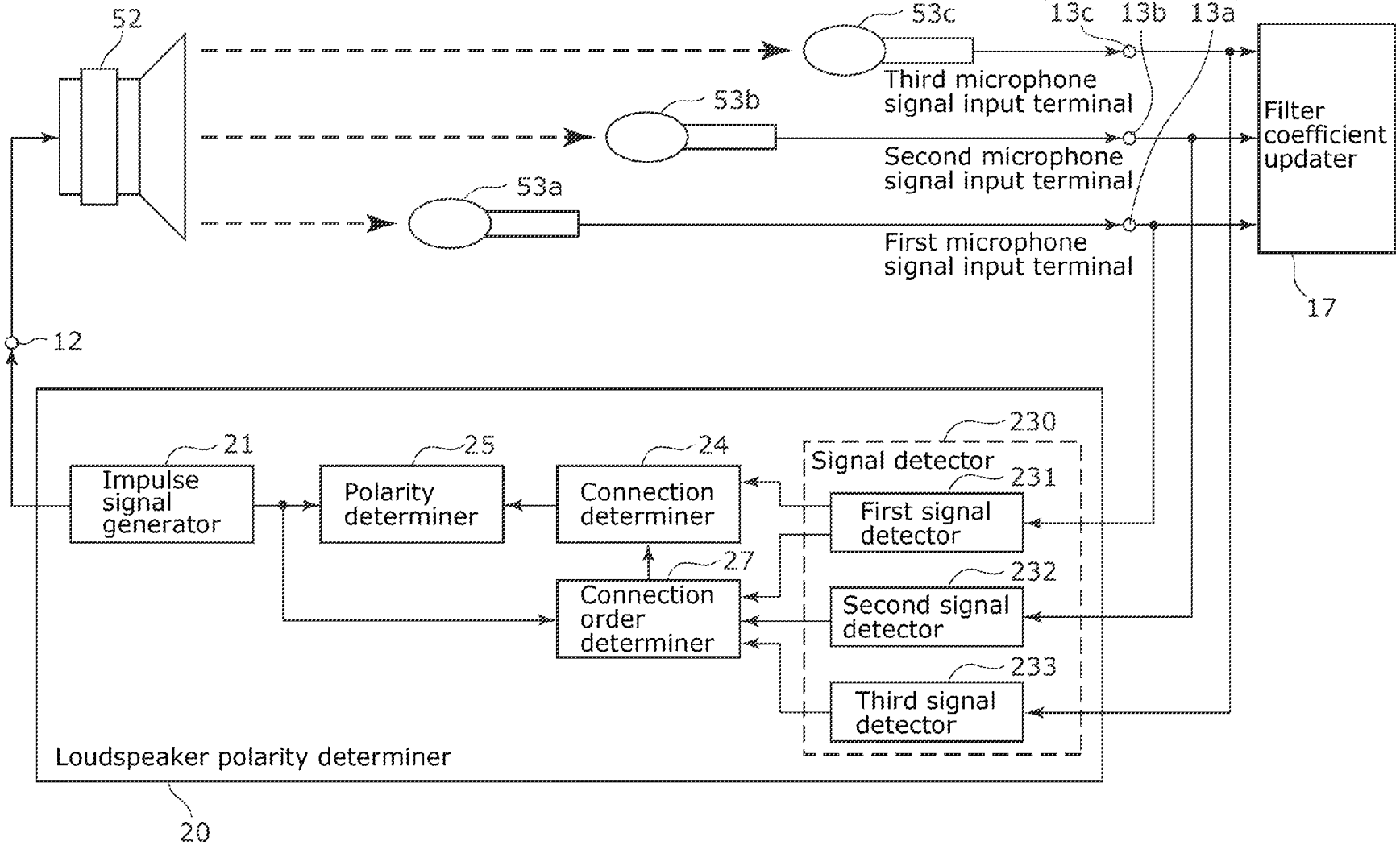
FIG. 7 is a diagram showing an example of the configuration in which a plurality of microphones are connected to the active noise reduction device in a modification of the embodiment.

FIG. 7 is a diagram showing an example of the configuration in which a plurality of microphones are connected to active noise reduction device 10.

Microphone signal input terminal 13 of active noise reduction device 10 in the present modification includes first microphone signal input terminal 13*a*, second microphone signal input terminal 13*b*, and third microphone signal input terminal 13*c*. Three microphones are connected to first microphone signal input terminal 13*a*, second microphone signal input terminal 13*b*, and third microphone signal input terminal 13*c* in a predetermined order. For example, the microphone closest to loudspeaker 52 is connected to first microphone signal input terminal 13*a*, the second closest microphone to loudspeaker 52 is connected to second microphone signal input terminal 13*b*, and the third closest microphone to loudspeaker 52 is connected to third microphone signal input terminal 13*c*. Accordingly, active noise reduction device 10 can cause loudspeaker 52 to output the canceling sound according to the microphone signals inputted to first microphone signal input terminal 13*a*, second microphone signal input terminal 13*b*, and third microphone signal input terminal 13*c*, respectively.

Loudspeaker polarity determiner 20 in the present modification further includes connection order determiner 27. Additionally, loudspeaker polarity determiner 20 includes signal detector 230, instead of signal detector 23 in the above-described embodiment. Signal detector 230 includes first signal detector 231, second signal detector 232, and third signal detector 233. Each of first signal detector 231, second signal detector 232, and third signal detector 233 includes the same function as signal detector 23 in the above-described embodiment. That is, first signal detector 231 receives, from the microphone connected to first microphone signal input terminal 13*a*, a microphone signal via that first microphone signal input terminal 13*a*, and detects the rising signal and the falling signal from the microphone signal. Similarly, second signal detector 232 receives, from the microphone connected to second microphone signal input terminal 13*b*, a microphone signal via that second microphone signal input terminal 13*b*, and detects the rising signal and the falling signal from the microphone signal. Similarly, third signal detector 233 receives, from the microphone connected to third microphone signal input terminal 13*c*, a microphone signal via that third microphone signal input terminal 13*c*, and detects the rising signal and the falling signal from the microphone signal.

Connection determiner 24 determines whether or not loudspeaker 52 is connected to signal output terminal 12, by using the rising signal and the falling signal that are detected by first signal detector 231. Polarity determiner 25 also determines the connection polarity between loudspeaker 52 and signal output terminal 12 by using the rising signal and the falling signal that are detected by first signal detector 231. Here, the rising signal and the falling signal detected by first signal detector 231 are the rising signal and the falling signal of the microphone signal outputted from the microphone connected to first microphone signal input terminal 13*a*, i.e., the microphone closest to loudspeaker 52.

For example, in the example shown in FIG. 7, microphone 53*a* is connected to first microphone signal input terminal 13*a* as the closest microphone to loudspeaker 52, and microphone 53*b* is connected to second microphone signal input terminal 13*b* as the second closest microphone to loudspeaker 52. Then, microphone 53*c* is connected to third microphone signal input terminal 13*c* as the third closest microphone to loudspeaker 52.

Therefore, when three microphones 53*a*, 53*b*, and 53*c* are connected to active noise reduction device 10 as described above, polarity determiner 25 determines the connection polarity between loudspeaker 52 and signal output terminal 12 based on the respective timings of the rising signal and the falling signal detected from the microphone signal of microphone 53*a*, which is the closest to loudspeaker 52 among three microphones 53*a*, 53*b*, and 53*c*.

In this manner, in the present modification, since the microphone signal outputted from microphone 53*a* closest to loudspeaker 52 is used for the determination of the connection polarity of loudspeaker 52, the accuracy of determining the connection polarity can be improved.

Here, for example, there is a case where, not microphone 53*a* closest to loudspeaker 52, but the other microphone 53*b* or 53*c* is connected to first microphone signal input terminal 13*a*. In such a case, it is difficult to obtain the above-described effect of high accuracy of determining the connection polarity.

Therefore, connection order determiner 27 in the present modification determines whether or not the three microphones are connected to active noise reduction device 10 in the predetermined order. That is, connection order determiner 27 determines whether or not microphone 53*a* closest to loudspeaker 52 is connected to first microphone signal input terminal 13*a*, microphone 53*b*, which is the second closest to loudspeaker 52, is connected to second microphone signal input terminal 13*b*, and microphone 53*c*, which is the third closest to loudspeaker 52, is connected to third signal input terminal 13*c*.

Specifically, when microphones 53*a*, 53*b*, and 53*c* are connected to active noise reduction device 10 as the plurality of microphones, signal detector 230 detects the rising signal and the falling signal from the microphone signal outputted from each of microphones 53*a*, 53*b*, and 53*c*. At this time, signal detector 230 uses first signal detector 231, second signal detector 232, and third signal detector 233.

Then, connection order determiner 27 determines whether or not microphones 53*a*, 53*b*, and 53*c* are connected to active noise reduction device 10 in the predetermined order, based on the timing of the rising signal and the timing of the falling signal in each of microphones 53*a*, 53*b*, and 53*c*, and the timing of outputting the impulse signal.

For example, connection order determiner 27 derives the time difference between the timing of the earlier one of the timing of the rising signal and the timing of the falling signal detected by first signal detector 231, and the timing at which outputting of the impulse signal is started as a first time difference. Similarly, connection order determiner 27 derives the time difference between the timing of the earlier one of the timing of the rising signal and the timing of the falling signal detected by second signal detector 232, and the timing at which outputting of the impulse signal is started as a second time difference. Further, connection order determiner 27 derives the time difference between the timing of the earlier one of the timing of the rising signal and the timing of the falling signal detected by third signal detector 233, and the timing at which outputting of the impulse signal is started as a third time difference. As a result, when the relationship of the first time difference<the second time difference<the third time difference is satisfied, connection order determiner 27 determines that microphones 53*a*, 53*b*, and 53*c* are connected to active noise reduction device 10 in the predetermined order. That is, connection order determiner 27 determines that microphone 53*a* closest to loudspeaker 52 is connected to first microphone signal input terminal 13*a*, microphone 53*b*, which is the second closest to loudspeaker 52, is connected to second microphone signal input terminal 13*b*, and microphone 53*c*, which is the third closest to loudspeaker 52, is connected to third microphone signal input terminal 13*c*. On the other hand, when the relationship of the first time difference<the second time difference<the third time difference is not satisfied, connection order determiner 27 determines that microphones 53*a*, 53*b*, and 53*c* are not connected to active noise reduction device 10 in the predetermined order.

Connection order determiner 27 may notify the determination result to connection determiner 24. In this case, when three microphones 53*a*, 53*b*, and 53*c* are connected to active noise reduction device 10 in the predetermined order, as described above, connection determiner 24 determines whether or not loudspeaker 52 is connected to signal output terminal 12, by using the rising signal and the falling signal that are detected by first signal detector 231. Polarity determiner 25 also determines the connection polarity between loudspeaker 52 and signal output terminal 12 by using the rising signal and the falling signal that are detected by first signal detector 231.

On the other hand, when three microphones 53*a*, 53*b*, and 53*c* are not connected to active noise reduction device 10 in the predetermined order, connection determiner 24 does not perform the determination using the rising signal and the falling signal that are detected by first signal detector 231. Polarity determiner 25 also does not perform the determination using the rising signal and the falling signal that are detected by first signal detector 231. Alternatively, connection determiner 24 and polarity determiner 25 may switch the rising signal and the falling signal that are used for the determination. That is, connection determiner 24 and polarity determiner 25 may obtain the rising signal and the falling signal detected from the microphone signal of the microphone closest to loudspeaker 52 from second signal detector 232 or third signal detector 233, and may perform the determination by using these signals.

In this manner, in the present modification, it is possible to appropriately determine whether or not microphones 53*a*, 53*b*, and 53*c* are connected to active noise reduction device 10 in an erroneous order. As a result, for example, when microphones 53*a*, 53*b*, and 53*c* are connected in the erroneous order, it is possible to suppress that the connection polarity of loudspeaker 52 is determined by using microphone 53*b* or 53*c*, which is different from microphone 53*a* closest to loudspeaker 52.

Note that, although the plurality of microphones connected to active noise reduction device 10 are three microphones 53*a*, 53*b*, and 53*c* in the example shown in FIG. 4, the number of the plurality of microphones is not limited to three. As long as the number of the plurality of microphones is two or more, the number may be any number. Additionally, active noise reduction device 10 may include the same number of microphone signal input terminals as the plurality of microphones to be connected.

OTHER EMBODIMENTS

Although an active noise reduction device according to one or more aspects of the present disclosure has been described based on the embodiments, the present disclosure is not limited to the embodiments. Those skilled in the art will readily appreciate that embodiments arrived at by making various modifications to the above embodiments or embodiments arrived at by selectively combining elements disclosed in the above embodiments without materially departing from the scope of the present disclosure may be included within one or more aspects of the present disclosure.

For example, when loudspeaker polarity determiner 20 repeatedly performs the determination of the connection and the connection polarity of loudspeaker 52, loudspeaker polarity determiner 20 repeatedly performs the signal output processing of the impulse signal. Here, when the sound corresponding to the impulse signal is outputted from loudspeaker 52, the value indicated by the microphone signal may remain unstable even after outputting of the impulse signal is stopped. Therefore, when loudspeaker polarity determiner 20 repeatedly performs the signal output processing of the impulse signal as described above, the signal output processing of the subsequent impulse signal is performed after a stabilization time has elapsed since outputting of the previous impulse signal is stopped. This stabilization time is, for example, 100 ms to 200 ms. Accordingly, even when the determination of the connection and the connection polarity of loudspeaker 52 is repeatedly performed, each determination can be appropriately performed.

Each of the elements in each of the above embodiments may be configured in the form of an exclusive hardware product, or may be realized by executing a software program suitable for the element. Each of the elements may be realized by means of a program executing unit, such as a CPU or a processor, reading and executing the software program recorded on a recording medium such as a hard disk or semiconductor memory. Here, a software program executing a neural network optimizing device or the like according to the above embodiments causes the computer to execute the processing indicated by at least one of the flowcharts of FIGS. 5 and 6.

The present disclosure also includes the followings.

(1) At least one of the above-described devices may be a computer system including a microprocessor, a Read Only Memory (ROM), a Random Access Memory (RAM), a hard disk unit, a display unit, a keyboard, a mouse, and the like. The RAM or the hard disk unit holds a computer program. The microprocessor operates according to the computer program, thereby causing at least one of the above-described devices to execute its functions. Here, the computer program includes combinations of instruction codes for issuing instructions to the computer to execute predetermined functions.

(2) A part or all of the constituent elements in at least one of the above-described devices may be implemented into a single Large Scale Integration (LSI). The system LSI is a super multi-function LSI that is a single chip into which a plurality of constituent elements are integrated. More specifically, the system LSI is a computer system including a microprocessor, a ROM, a RAM, and the like. The RAM holds a computer program. The microprocessor operates according to the computer program, thereby causing the system LSI to execute its functions.

(3) A part or all of the constituent elements included in at least one of the above-described devices may be implemented into an Integrated Circuit (IC) card or a single module which is attachable to and removable from the device. The IC card or the module is a computer system including a microprocessor, a ROM, a RAM, and the like. The IC card or the module may include the above-described super multi-function LSI. The microprocessor operates according to the computer program to cause the IC card or the module to execute its functions. The IC card or the module may have tamper resistance.

(4) The present disclosure may be the above-described methods. These methods may be a computer program executed by a computer, or digital signals forming the computer program.

The present disclosure may be a computer-readable recording medium on which the computer program or the digital signals are recorded. Examples of the computer-readable recording medium are a flexible disk, a hard disk, a Compact Disc-Read Only Memory (CD-ROM), a magnetooptic disk (MO), a Digital Versatile Disc (DVD), a DVD-ROM, a DVD-RAM, a BD (Blu-ray® Disc), and a semiconductor memory. The present disclosure may be the digital signals recorded on the recording medium.

The present disclosure may be implemented by transmitting the computer program or the digital signals via an electric communication line, a wired or wireless communication line, a network represented by the Internet, data broadcasting, and the like.

It is also possible that the program or the digital signals may be recorded onto the recording medium to be transferred, or may be transmitted via a network or the like, so that the program or the digital signals can be executed by a different independent computer system.

While various embodiment has been described herein above, it is to be appreciated that various changes in form and detail may be made without departing from the spirit and scope of the present disclosure as presently or hereafter claimed.

Further Information about Technical Background to this Application

The disclosure of the following Japanese Patent Application including specification, drawings and claims is incorporated herein by reference in its entirety: Japanese Patent Application No. 2020-058055 filed on Mar. 27, 2020.

INDUSTRIAL APPLICABILITY

The active noise reduction device of the present disclosure is useful as, for example, an apparatus capable of reducing the noise in the cabin.

The invention claimed is:

1. An active noise reduction device that reduces noise, the active noise reduction device comprising:

an impulse signal generator that generates an impulse signal;

a signal output terminal that outputs the impulse signal to a loudspeaker for reducing the noise;

a signal detector that detects a rising signal and a falling signal from a microphone signal outputted from a microphone collecting sound; and a processor, which when executing instructions stored in a memory, is configured as a connection determiner that determines, based on respective peak values of the rising signal detected and the falling signal detected, whether or not the loudspeaker is connected to the signal output terminal; and a polarity determiner that determines a connection polarity between the loudspeaker and the signal output terminal based on respective timings of the rising signal and the falling signal with respect to the impulse signal, when the connection determiner determines that the loudspeaker is connected to the signal output terminal.

2. The active noise reduction device according to claim 1, wherein the polarity determiner determines the connection polarity by determining which of the rising signal and the falling signal occurs at each of a first timing and a second timing, the first timing corresponding to starting the outputting of the impulse signal, the second timing corresponding to stopping the outputting of the impulse signal.

3. The active noise reduction device according to claim 2, wherein when the rising signal occurs at the first timing and the falling signal occurs at the second timing, the polarity determiner determines that the connection polarity is positive.

4. The active noise reduction device according to claim 1, wherein the signal detector detects the rising signal and the falling signal from the microphone signal, during a determination period between a determination start timing and a determination completion timing, the determination period being set in accordance with a distance between the loudspeaker and the microphone and a timing of outputting the impulse signal.

5. The active noise reduction device according to claim 1, wherein the connection determiner determines that the loudspeaker is connected to the signal output terminal, when each of absolute values of the respective peak values of the rising signal and the falling signal is equal to or greater than a threshold value.

6. The active noise reduction device according to claim 1, further comprising:

a canceling signal generator that generates a canceling signal and outputs the canceling signal to the signal output terminal, wherein when the polarity determiner determines that the connection polarity is negative, the canceling signal generator inverses a phase of the canceling signal generated to cause the loudspeaker to output canceling sound to reduce the noise.

7. The active noise reduction device according to claim 1, wherein when a plurality of microphones are connected to the active noise reduction device, the polarity determiner determines the connection polarity between the loudspeaker and the signal output terminal, based on respective timings of a rising signal and a falling signal which are detected from a microphone signal of a microphone closest to the loudspeaker among the plurality of microphones.

8. The active noise reduction device according to claim 7, wherein the signal detector detects a rising signal and a falling signal from a microphone signal outputted from each of the plurality of microphones.

9. The active noise reduction device according to claim 8, wherein the processor, when executing the instructions stored in the memory, is further configured as a connection order determiner that determines whether or not the plurality of microphones are connected to the active noise reduction device in a predetermined order, based on (i) respective timings of a rising signal and a falling signal of a microphone signal outputted from each of the plurality of microphones, and (ii) a timing of outputting the impulse signal.

10. The active noise reduction device according to claim 1, wherein the active noise reduction device is mounted on a vehicle.

11. An active noise reduction method executed by a computer to reduce noise, the active noise reduction method comprising:

generating an impulse signal;

performing signal output processing for outputting the impulse signal via a signal output terminal to a loudspeaker for reducing the noise;

detecting a rising signal and a falling signal from a microphone signal outputted from a microphone collecting sound;

determining whether or not the loudspeaker is connected to the signal output terminal, based on respective peak values of the rising signal detected and the falling signal detected; and determining a connection polarity between the loudspeaker and the signal output terminal based on respective timings of the rising signal and the falling signal with respect to the impulse signal, when the determination is made that the loudspeaker is connected to the signal output terminal.

* * * * *